US008378775B2

(12) United States Patent
Schiene et al.

(10) Patent No.: US 8,378,775 B2
(45) Date of Patent: Feb. 19, 2013

(54) PLANAR TRANSFORMER WITH BOARDS

(75) Inventors: Wolfgang Schiene, Wurselen (DE); Georg Greuel, Roetgen (DE); Marc Maria Alex Bleukx, Mechelen (BE); Roman Siegfried Schichl, Passau (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 12/596,495

(22) PCT Filed: Apr. 17, 2008

(86) PCT No.: PCT/IB2008/051473

§ 371 (c)(1), (2), (4) Date: Oct. 19, 2009

(87) PCT Pub. No.: WO2008/132645

PCT Pub. Date: Nov. 6, 2008

(65) Prior Publication Data

US 2010/0253461 A1 Oct. 7, 2010

(30) Foreign Application Priority Data

Apr. 26, 2007 (EP) ..... 07106993

(51) Int. Cl.
*H01F 5/00* (2006.01)
*H01F 27/02* (2006.01)
*H01F 27/28* (2006.01)

(52) U.S. Cl. ..... 336/200; 336/82; 336/83; 336/90; 336/232

(58) Field of Classification Search ..... 336/82, 336/83, 90, 200, 232
See application file for complete search history.

(56) References Cited

U.S. PATENT DOCUMENTS

| | | | | |
|---|---|---|---|---|
| 4,253,079 | A | 2/1981 | Brosh | |
| 6,211,767 | B1 | 4/2001 | Jitaru | |
| 6,392,519 | B1 * | 5/2002 | Ronning | 336/90 |
| 6,556,117 | B1 | 4/2003 | Nakao et al. | |
| 6,914,508 | B2 * | 7/2005 | Ferencz et al. | 336/200 |
| 2002/0070834 | A1 * | 6/2002 | Dadafshar | 336/200 |
| 2002/0167388 | A1 * | 11/2002 | Usui | 336/200 |
| 2004/0042240 | A1 * | 3/2004 | Takeshima et al. | 363/74 |
| 2004/0070481 | A1 * | 4/2004 | Patel et al. | 336/200 |

(Continued)

FOREIGN PATENT DOCUMENTS

| | | | |
|---|---|---|---|
| DE | 2409881 | A | 9/1975 |
| DE | 4137776 | A1 | 5/1993 |

(Continued)

*Primary Examiner* — Mohamad Musleh
*Assistant Examiner* — Tsz Chan

(57) ABSTRACT

Transformers (1) for transforming primary signals into secondary signals comprise primary and secondary parts that comprise boards (11-14, 21-23) with turns. By introducing distances larger than zero between for example any pair of neighboring boards (11-14, 21-23), parasitic capacitances of the transformers (1) are reduced, and the secondary signals may comprise relatively fast/high voltage pulses having rise times >1 kV/μsec. To reduce proximity effects and any resulting losses, the primary and secondary boards (11-14, 21-23) may be stacked in interleaved ways. Such sandwich constructions reduce leakage inductances. In a particular direction, distances between subsequent primary boards (11-14, 21-23) and distances between subsequent combinations of primary and secondary boards (11-14, 21-23) are to be increased to further reduce capacitive losses in that particular direction. Relatively low voltage differences may be present between relatively close boards (11-14, 21-23), and relatively high voltage differences may be present between boards (11-14, 21-23) that are relatively far away from each other.

11 Claims, 2 Drawing Sheets

U.S. PATENT DOCUMENTS

2005/0242916 A1 11/2005 So

FOREIGN PATENT DOCUMENTS

| | | | |
|---|---|---|---|
| EP | 0491214 | A1 | 6/1992 |
| EP | 0782154 | A1 | 7/1997 |
| EP | 1168387 | A2 | 1/2002 |
| WO | 2005076672 | A1 | 8/2005 |
| WO | 2006033071 | A1 | 3/2006 |

* cited by examiner

PLANAR TRANSFORMER WITH BOARDS

FIELD OF THE INVENTION

The invention relates to a transformer for transforming a primary signal into a secondary signal, and also relates to a device comprising such a transformer, and to a method for producing such a transformer.

BACKGROUND OF THE INVENTION

U.S. Pat. No. 6,211,767 B1 discloses in its title a planar transformer and discloses in its FIG. 13 the planar transformer comprising one primary printed circuit board and two secondary printed circuit boards. The primary printed circuit board is sandwiched in between the secondary printed circuit boards. A copper spacer located in parallel with the primary printed circuit board interconnects the secondary printed circuit boards.

SUMMARY OF THE INVENTION

It is an object of the invention to provide a transformer for transforming a primary signal into a secondary signal, which secondary signal may comprise relatively fast pulses and/or relatively high voltage pulses. Such pulses for example comprise a rise time >1 kV/μsec.

Further objects of the invention are to provide a device comprising such a transformer and to provide a method for producing such a transformer.

According to a first aspect of the invention, a transformer for transforming a primary signal into a secondary signal is defined by the transformer comprising a primary part for receiving the primary signal and a secondary part for supplying the secondary signal, the primary and secondary parts each comprising at least one board, each board comprising at least a part of at least one turn, a distance between two neighboring boards being larger than zero.

By having introduced a distance larger than zero between for example any pair of neighboring boards, a parasitic capacitance of the transformer is reduced. As a result, the secondary signal may comprise relatively fast pulses and/or relatively high voltage pulses having a rise time >1 kV/μsec.

Each board such as, for example, a printed circuit board with copper turns or such as, for example, another board with an insulating layer and a conducting layer, comprises at least a part of at least one turn. The turn is for example formed from one or more patterned conductive traces, for example of copper. A trace for example forms a nearly closed circular pattern, so as to create an electromagnetic equivalence of a turn or a loop of a wire-formed winding. A pattern may be in the form of a C, with the extreme points of the C being the terminal points.

According to an embodiment of the transformer, the transformer is defined by one of the primary and secondary parts comprising at least first and second boards and the other one of the primary and secondary parts comprising at least a further board, and the further board being at least partly located between the first and second boards.

By having stacked the primary and secondary boards in an interleaved way, in other words by having created a sandwich construction of primary and secondary boards, a proximity effect is reduced and losses resulting from such a proximity effect are reduced.

According to an embodiment of the transformer, the transformer is defined by one of the primary and secondary parts comprising at least first and second and third boards and the other one of the primary and secondary parts comprising at least fourth and fifth boards, the fourth board being at least partly located between the first and second boards, and the fifth board being at least partly located between the second and third boards.

By having stacked the primary and secondary boards in an interleaved way, in other words by having created a sandwich construction of primary and secondary boards, a proximity effect is reduced and losses resulting from such a proximity effect are reduced.

The above defined stacking in an interleaved way (the sandwich construction) reduces a leakage inductance of the transformer. In combination with a distance between for example any pair of neighboring boards being larger than zero, the secondary signal may then comprise even faster pulses and/or even higher voltage pulses.

According to an embodiment of the transformer, the transformer is defined by a distance between the first and second boards being smaller than a distance between the second and third boards.

By increasing a distance, in a particular direction, between subsequent primary boards, capacitive losses are further reduced in that particular direction.

According to an embodiment of the transformer, the transformer is defined by a distance between the first and fourth boards being smaller than a distance between the fourth and second boards.

By increasing a distance, in a particular direction, between subsequent combinations of a primary board and a secondary board, capacitive losses are further reduced in that particular direction.

According to an embodiment of the transformer, the transformer is defined by the distance between the fourth and second boards being smaller than a distance between the second and fifth boards and the distance between the second and fifth boards being smaller than a distance between the fifth and third boards.

By increasing a distance, in a particular direction, between subsequent combinations of a primary board and a secondary board, capacitive losses are further reduced in that particular direction.

According to an embodiment of the transformer, the transformer is defined by the turns of the first and second and third boards being serially coupled to each other, the turns of the fourth and fifth boards being serially coupled to each other, and a point of at least one of the first and fourth boards being a ground point.

Preferably, the particular direction is a direction perpendicular to the boards and starts at the first (fourth) board and extends towards the second and third (fifth) board. Then, with the first (fourth) board being connected to ground, a relatively low voltage difference will be present between relatively close boards, and a relatively high voltage difference will be present between boards that are relatively far away from each other. Such a transformer comprises three different improvements (a distance larger than zero between for example any pair of neighboring boards+a sandwich construction+increasing distances for increasing voltages) and can transform a primary signal into a secondary signal that comprises pulses with a rise time >10 kV/μsec.

According to an embodiment of the transformer, the transformer is defined by the transformer further comprising a core with two outer legs and an inner leg, the boards being substantially parallel and/or substantially planar printed circuit boards, the turns being prints on the printed circuit boards and surrounding the inner leg and being surrounded by the outer legs, the transformer being impregnated with heat conducting and voltage isolating resin, and the transformer further comprising an aluminum container acting as a heat sink and an electro magnetic interference shield for the boards.

The core may be realized by combining two E80 cores. The distance between two neighboring boards may be established in and/or near the core(s). The transformer may be used at many different power levels, such as power levels below 100 Watt, or power levels from 100 to 10,000 Watt, or power levels above 10,000 Watt. The primary boards may be interconnected serially via another board that is substantially perpendicular to the primary boards. The secondary boards may be interconnected serially via pins.

According to a second aspect of the invention, a device comprising a transformer is defined by the device further comprising a source for generating the primary signal and/or a load for receiving the secondary signal.

The source for example comprises a half bridge or a full bridge. The load for example comprises a dielectric barrier discharge lamp.

According to a third aspect of the invention, a method for producing a transformer is defined by the method comprising a step of mounting two neighboring boards at the distance from each other.

An insight may be that a leakage inductance and a parasitic capacitance of a transformer comprising boards with turns depend on a location of these boards and turns. A basic idea may be that between for example any pair of neighboring boards, a distance larger than zero should be present, to allow relatively fast pulses and/or relatively high voltage pulses.

The problem of providing a transformer for transforming a primary signal into a secondary signal, which secondary signal may comprise relatively fast pulses and/or relatively high voltage pulses, is solved. A further advantage may be that the transformer is relatively compact and has relatively low power losses.

These and other aspects of the invention will be apparent from and elucidated with reference to the embodiments(s) described hereinafter.

DETAILED DESCRIPTION OF EMBODIMENTS

Figure 1:
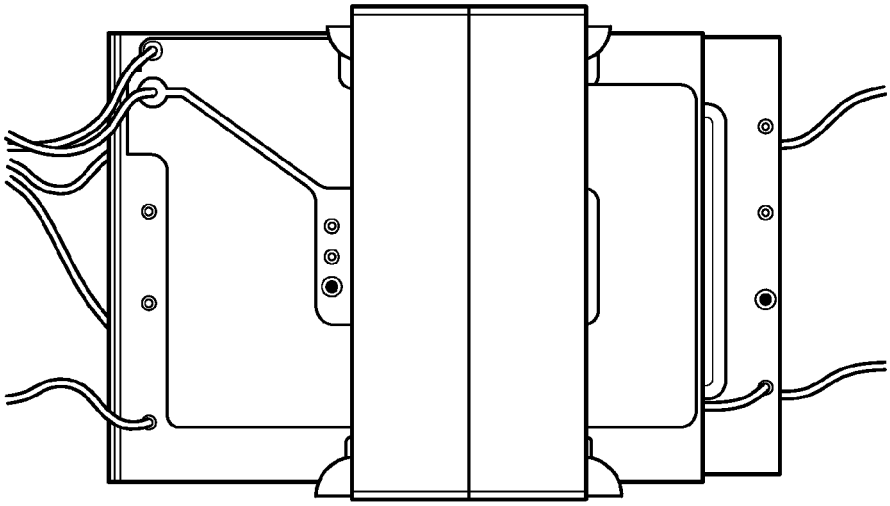
FIG. 1 shows a top view picture of a transformer according to the invention.

In FIG. 1, a top view picture of a transformer according to the invention is shown. Clearly recognizable are a (primary) upper board and a (secondary) board located under the upper board, which are surrounded by two cores. The upper board comprises one turn, or more precisely, the upper board comprises a patterned conductive trace in the form of a nearly closed circular pattern, so as to create an electromagnetic equivalent of a turn or a loop of a wire-formed winding. The board located under the upper board comprises more than one turn.

Figure 2:
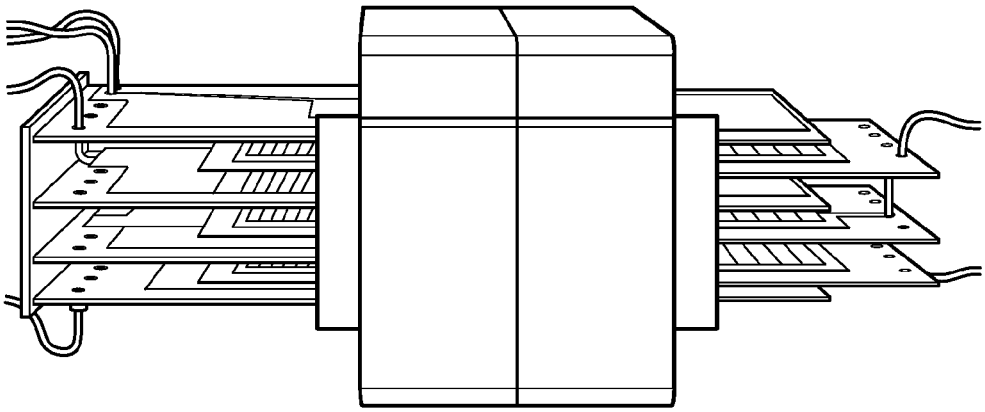
FIG. 2 shows a side view picture of a transformer according to the invention.

In FIG. 2, a side view picture of a transformer according to the invention is shown. Clearly recognizable are four (primary) boards and three (secondary) boards stacked in an interleaved way and surrounded by the two cores. The four (primary boards) are serially interconnected via another board that is substantially perpendicular to the four (primary) boards. The three (secondary) boards are serially interconnected via pins.

Figure 3:
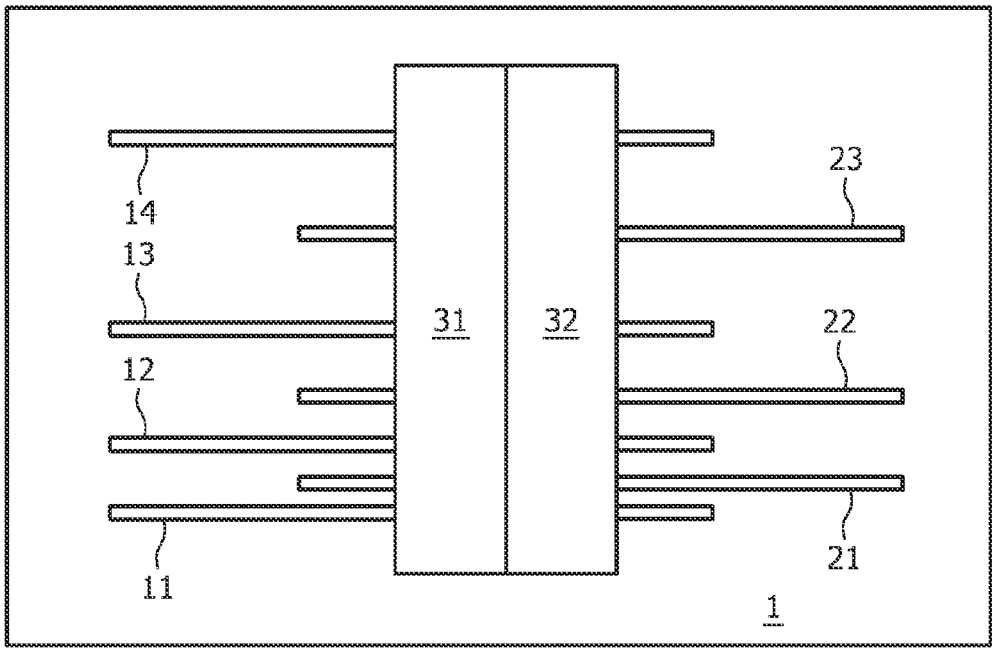
FIG. 3 shows a side view diagram of a transformer according to the invention.

In FIG. 3, a side view diagram of a transformer 1 according to the invention is shown, in line with FIG. 2. The transformer 1 comprises at its primary side (left), in an upgoing direction, a board 11 with for example one turn, a board 12 with for example two turns, a board 13 with for example two turns, and a board 14 with for example one turn. The transformer 1 comprises at its secondary side (right), in an upgoing direction, a board 21 with for example fifteen turns, a board 22 with for example fourteen turns, and a board 23 with for example fifteen turns. The transformer 1 further comprises for example two cores 31-32, each having for example two outer legs and an inner leg. The turns for example surround the inner legs and are surrounded by the outer legs.

Instead of using two cores 31-32, one larger core or three or more cores may be used. The boards 11-14 and 21-23 are for example substantially parallel boards and/or are for example substantially planar printed circuit boards. The turns may be prints on the printed circuit boards. The transformer 1 may be impregnated with heat conducting and voltage isolating resin, and the transformer 1 may further comprise an aluminum container acting as a heat sink and an electro magnetic interference shield for the boards 11-14 and 21-23.

Figure 4:
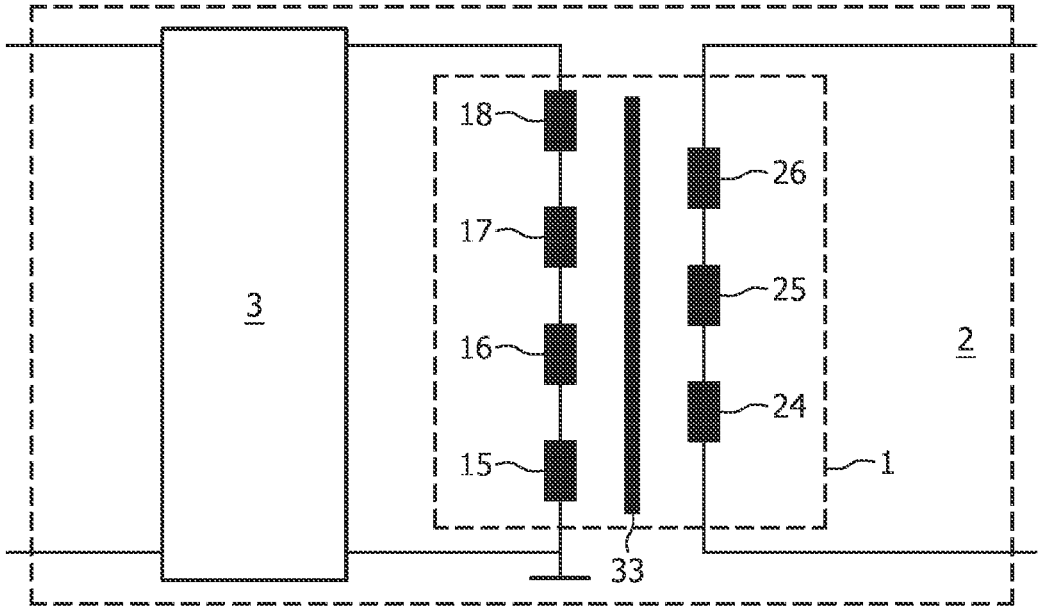
FIG. 4 shows diagrammatically a device according to the invention comprising a transformer according to the invention.

In FIG. 4, a device 2 according to the invention comprising a transformer 1 according to the invention is shown diagrammatically. The transformer 1 is shown here in the form of an equivalent circuit. The circuit comprises a core 33 that for example corresponds with the cores 31-32 discussed before. The circuit further comprises four primary inductors or primary groups of turns 15-18, a group of turns 15 (for example one turn) being located on the board 11, a group of turns 16 (for example two turns) being located on the board 12, a group of turns 17 (for example two turns) being located on the board 13, and a group of turns 18 (for example one turn) being located on the board 14. The circuit further comprises three secondary inductors or secondary groups of turns 24-26, a group of turns 24 (for example fifteen turns) being located on the board 21, a group of turns 25 (for example fourteen turns) being located on the board 22, and a group of turns 26 (for example fifteen turns) being located on the board 23. The primary side of the transformer 1 is coupled to a source 3 such as a half bridge or a full bridge, which source 3 is further to be coupled to for example a DC supply. The secondary side of the transformer 1 is further to be coupled to for example a load, not shown.

The transformer 1 transforms a primary signal originating from the source 3 into a secondary signal destined for a load. The transformer 1 comprises a primary part for receiving the primary signal and a secondary part for supplying the secondary signal. These primary and secondary parts each comprise at least one board 11-14 and 21-23, and each board comprises at least a part of at least one turn. By introducing a distance larger than zero between for example any pair of neighboring boards 11-14 and 21-23, a parasitic capacitance of the transformer 1 is reduced. As a result, the secondary signal may comprise relatively fast pulses and/or relatively high voltage pulses having a rise time >1 kV/μsec.

For example, one of the primary and secondary parts comprises at least two boards 11-12 and the other one of the primary and secondary parts comprises at least one board 21, and the board 21 is at least partly located between the boards 11-12. Or, for example, one of the primary and secondary parts comprises at least three boards 11-13 and the other one of the primary and secondary parts comprises at least two boards 21-22, the board 21 being at least partly located between the boards 11-12, and the board 22 being at least partly located between the boards 12-13. This way, the primary and secondary boards have been stacked in an interleaved way. In other words, a sandwich construction of primary and secondary boards has been created to reduce a proximity effect and losses resulting from such a proximity effect. This reduces a leakage inductance of the transformer.

A distance between the boards 11-12 is smaller than a distance between the boards 12-13. By increasing a distance, in a particular direction, between subsequent primary boards, capacitive losses are further reduced in that particular direction. A distance between the boards 11 and 21 is smaller than a distance between the boards 21 and 12.

By increasing a distance, in a particular direction, between subsequent combinations of a primary board and a secondary board, capacitive losses are further reduced in that particular direction. The distance between the boards 21 and 12 is smaller than a distance between the boards 12 and 22 and the distance between the boards 12 and 22 is smaller than a distance between the boards 22 and 13, etc. By increasing a distance, in a particular direction, between subsequent combinations of a primary board and a secondary board, capacitive losses are further reduced in that particular direction.

A point of at least one of the boards 11 and 21 is a ground point. Then, this board 11 and/or 21 is connected to ground, and a relatively low voltage difference will be present between relatively close boards, and a relatively high voltage difference will be present between boards that are relatively far away from each other. Such a transformer comprises three different improvements (a distance larger than zero between for example any pair of neighboring boards+a sandwich construction+increasing distances for increasing voltages) and can transform a primary signal into a secondary signal that comprises pulses with a rise time >10 kV/μsec.

The transformer according to the invention, which is based on a construction with for example planar printed circuit boards or PCBs on which the windings are printed in copper, has a good thermal coupling and a low leakage induction. By stacking the primary and secondary winding PCBs in an interleaved way, it is avoided that too many winding PCBs that carry a same current are adjacent to each other (the number of peak ampere turns going in one direction are kept low so that the proximity effect is limited). In case all primary winding layers were stacked upon one another and all secondary winding layers were also be stacked upon one another, the proximity effect losses would increase exponentially, resulting in too high copper power losses.

To minimize the copper power losses and leakage induction, a relatively low number of turns for the windings is to be used, and a relatively large core section is to be used (for example two E80 core pairs against each other).

To reduce the primary-secondary stray capacitance, the distances between the interleaved primary-secondary PCBs is enlarged as the secondary voltage is built up, so that the PCB with the highest secondary voltage is located at the largest distance from the primary PCBs. The (horizontal) primary PCBs are interconnected via a (vertical) PCB at the left side, while the secondary PCBs are interconnected by vertical pins.

A primary number of primary boards and a secondary number of secondary boards can be chosen arbitrarily, under the condition that a distance between two neighboring boards is larger than zero.

Summarizing, transformers 1 for transforming primary signals into secondary signals comprise primary and secondary parts that comprise boards 11-14, 21-23 with turns. By introducing distances larger than zero between for example any pair of neighboring boards 11-14, 21-23, parasitic capacitances of the transformers 1 are reduced, and the secondary signals may comprise relatively fast/high voltage pulses having rise times >1 kV/μsec. To reduce proximity effects and any resultant losses, the primary and secondary boards 11-14, 21-23 may be stacked in interleaved ways. Such sandwich constructions reduce leakage inductances. In a particular direction, distances between subsequent primary boards 11-14, 21-23 and distances between subsequent combinations of primary and secondary boards 11-14, 21-23 are to be increased to further reduce capacitive losses in that particular direction. Relatively low voltage differences may be present between relatively close boards 11-14, 21-23, and relatively high voltage differences may be present between boards 11-14, 21-23 that are relatively far away from each other.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A transformer for transforming a primary signal into a secondary signal, wherein the transformer comprises a primary part for receiving the primary signal and a secondary part for supplying the secondary signal, the primary and secondary parts each comprising at least one board, each board comprising at least a part of at least one turn, a distance between any two neighboring boards being larger than zero;

wherein one of the primary and secondary parts comprises at least first and second and third boards and the other one of the primary and secondary parts comprises at least fourth and fifth boards, the fourth board being at least partly located between the first and second boards, and the fifth board being at least partly located between the second and third boards; such that so located, no two neighboring boards are boards from the same part of the transformer; and, the minimum distance between the first and second boards is smaller than the minimum distance between the second and third boards.

2. A transformer according to claim 1, wherein a distance between the first and fourth boards is smaller than a distance between the fourth and second boards.

3. A transformer according to claim 2, wherein the distance between the fourth and second boards is smaller than a distance between the second and fifth boards, and the distance between the second and fifth boards is smaller than a distance between the fifth and third boards.

4. A transformer according to claim 1, wherein the turns of the first and second and third boards are serially coupled to each other, the turns of the fourth and fifth boards are serially coupled to each other, and a point of at least one of the first and fourth boards is a ground point.

5. A device comprising a transformer according to claim 1, wherein the device further comprises a source for generating the primary signal and/or a load for receiving the secondary signal.

6. A method for producing a transformer according to claim 1, wherein the method comprises a step of mounting two neighboring boards at a distance from each other.

7. A transformer for transforming a primary signal into a secondary signal, wherein the transformer comprises a primary part for receiving the primary signal and a secondary part for supplying the secondary signal, the primary and secondary parts each comprising at least one board, each board comprising at least a part of at least one turn, a distance between two neighboring boards being larger than zero;

wherein one of the primary and secondary parts comprises at least first and second and third boards and the other one of the primary and secondary parts comprises at least fourth and fifth boards, the fourth board being at least partly located between the first and second boards, and the fifth board being at least partly located between the second and third boards; such that so located, no two neighboring boards are boards from the same part of the transformer; and, wherein the distance between the first and fourth boards is smaller than the distance between the fourth and second boards, the distance between the fourth and second boards is smaller than a distance between the second and fifth boards, and the distance between the second and fifth boards is smaller than a distance between the fifth and third boards.

8. A transformer according to claim 7, wherein the turns of the first and second and third boards are serially coupled to each other, the turns of the fourth and fifth boards are serially coupled to each other, and a point of at least one of the first and fourth boards is a ground point.

9. A device comprising a transformer according to claim 7, wherein the device further comprises a source for generating the primary signal and/or a load for receiving the secondary signal.

10. A method for producing a transformer according to claim 7, wherein the method comprises a step of mounting two neighboring boards at a distance from each other.

11. A transformer for transforming a primary signal into a secondary signal, the transformer having a central vertical axis, and comprising:

a primary part for receiving the primary signal and a secondary part for supplying the secondary signal, the primary and secondary parts each comprising at least one board, each board comprising at least a part of at least one turn, a distance between two neighboring boards being larger than zero;

wherein the primary part and the secondary part are asymmetric with respect to the central vertical axis; and, wherein one of the primary and secondary parts comprises at least first and second and third boards and the other one of the primary and secondary parts comprises at least fourth and fifth boards, the fourth board being at least partly located between the first and second boards, and the fifth board being at least partly located between the second and third boards; such that so located, no two neighboring boards are boards from the same part of the transformer; and, the minimum distance between the first and second boards is smaller than the minimum distance between the second and third boards.

* * * * *